US005642824A

United States Patent [19]

Hess, III et al.

[11] Patent Number: 5,642,824

[45] Date of Patent: Jul. 1, 1997

[54] CLOSURE WITH MULTIPLE AXIS BISTABLE HINGE STRUCTURE

[75] Inventors: John M. Hess, III, Waukesha; Nicholas J. Jelich, Oconomowoc; Bruce M. Mueller, Brookfield, all of Wis.

[73] Assignee: AptarGroup, Inc., Crystal Lake, Ill.

[21] Appl. No.: 568,806

[22] Filed: Dec. 7, 1995

[51] Int. Cl.[6] ..... B65D 47/08

[52] U.S. Cl. ..... 215/235; 215/237; 220/335; 220/339

[58] Field of Search ..... 215/235, 237, 215/238; 220/335, 339

[56] References Cited

U.S. PATENT DOCUMENTS

| | | | |
|---|---|---|---|
| 1,928,445 | 9/1933 | Boyd . | |
| 3,135,456 | 6/1964 | Palazzolo . | |
| 4,403,712 | 9/1983 | Wiesinger . | |
| 4,726,091 | 2/1988 | Joyce . | |
| 5,067,624 | 11/1991 | Thanisch | 215/235 |
| 5,115,931 | 5/1992 | Dubach | 215/235 |
| 5,143,234 | 9/1992 | Lohrman et al. | 215/235 |
| 5,356,017 | 10/1994 | Rohr et al. | 215/216 |
| 5,489,035 | 2/1996 | Fuchs | 215/235 |
| 5,531,349 | 7/1996 | Wojcik et al. | 220/339 |
| 5,558,239 | 9/1996 | Dubach | 215/235 |

FOREIGN PATENT DOCUMENTS

| | | |
|---|---|---|
| 0590325A2 | 4/1994 | European Pat. Off. . |
| 0631942A1 | 1/1995 | European Pat. Off. . |
| 1960247 | 2/1967 | Germany . |
| 4239299A1 | 3/1994 | Germany . |
| 94/20713 | 9/1994 | WIPO . |

*Primary Examiner*—Stephen K. Cronin

*Attorney, Agent, or Firm*—Dressler, Goldsmith, Shore & Milnamow, Ltd.

[57] ABSTRACT

A closure is provided for a container opening. The closure includes a base for mounting to the container and a lid movable between a closed position and an open position. The lid and base are connected by a bistable, snap-action hinge structure of the type that includes a web having a central portion between two wider ends wherein an arcuate film hinge connects the base to the web along one side of the web between the ends and wherein an arcuate film hinge connects the lid to the web along another side of the web between the ends. The hinge structure includes an abutment surface located so that when the lid is in a closed position, the abutment surface extends adjacent the web's central portion from an elevation adjacent one of the film hinges to an elevation that is preferably adjacent or higher than the other film hinge. The abutment surface is contacted by the web's central portion as the lid is closed or opened whereby the position of the web is controlled.

18 Claims, 15 Drawing Sheets

CLOSURE WITH MULTIPLE AXIS BISTABLE HINGE STRUCTURE

TECHNICAL FIELD

This invention relates to container closures. The invention is particularly suitable for use with a squeeze-type container dispensing closure which can be opened to dispense a fluid product from the container when the container is squeezed.

BACKGROUND OF THE INVENTION AND TECHNICAL PROBLEMS POSED BY THE PRIOR ART

A variety of packages, including dispensing packages or containers, have been developed for personal care products such as shampoo, lotions, etc., as well as for other fluid materials. One type of closure for these kinds of containers typically has a bistable hinge structure connecting a lid to a base mounted over the container opening. The hinge structure has a snap-action biasing force which maintains the lid in a selected closed or open position.

One type of bistable hinge structure incorporated in a closure is disclosed in U.S. Pat. No. 3,135,456. This patent discloses a snap-action hinge structure comprising a thin hinge web joining a base and a lid to accommodate movement of the lid between an open and closed position. The hinge structure has two, spaced-apart pivot axes. In particular, the hinge structure incorporates two, spaced-apart film hinges, one film hinge having an arcuate configuration connecting the lid to the hinge web and the other film hinge having an arcuate configuration connecting the base to the hinge web. The two pivot axes are defined by two parallel lines wherein, at points where the two film hinges are closest to each other, one line is tangent to the lid film hinge and the other line is tangent to the body film hinge.

The multiple axis hinge structure disclosed in U.S. Pat. No. 3,135,456 does not include a single, fixed geometric pivot axis such as is employed in the type of snap-action hinge for a cylindrical closure disclosed in U.S. Pat. No. 4,403,712. The hinge structure disclosed in the U.S. Pat. No. 3,135,456 operates in a different manner. Further, the multiple axis hinge structure disclosed in U.S. Pat. No. 3,135,456 accommodates certain design and manufacturing advantages. For example, the two spaced-apart film hinges can be more easily manufactured without stress risers because there is no need to vary the thickness of the film hinges along the length of the film hinges.

In contrast, the hinge structure for a cylindrical closure disclosed in U.S. Pat. No. 4,403,712 has a single, main geometric axis film hinge and has two film hinges which diverge. In commercial embodiments of the cylindrical closure having a single axis hinge structure disclosed in the U.S. Pat. No. 4,403,712, the film hinge thickness changes along the length of the film hinges. The thickness transition regions can define stress risers which may ultimately have a deleterious effect upon the structure during repeated operation.

The multiple axis hinge structure disclosed in the U.S. Pat. No. 3,135,456 has manufacturing advantages over the single geometric axis type hinge disclosed in U.S. Pat. No. 4,403,712. In particular, the less complex hinge geometry of the hinge structure disclosed in U.S. Pat. No. 3,135,456 simplifies design work, tooling construction and maintenance, inspection, and quality control procedures for products incorporating such a design.

Further, owing to the uniform cross-sectional thickness of the multiple film hinges along the lid and body circumferences, the hinge structure disclosed in the U.S. Pat. No. 3,135,456 can be molded more uniformly by means of injection molding. This prevents, or substantially minimizes, weld line formation in the web between the two film hinges, particularly along the film hinge which attaches the web to the lid.

While the hinge structure disclosed in U.S. Pat. No. 3,135,456 offers numerous advantages over single pivot axis hinge structures, it would be desirable to provide an improved design in which the opening and closing action of the hinge structure could be more carefully controlled.

Further, it would be beneficial if such an improved design could more readily accommodate incorporation in closures having different types of lid and base configurations and different sizes.

In particular, it would be especially desirable to provide a hinge structure which would accommodate simple design changes to provide a hinge biasing force of a desired magnitude. For example, in some applications, a smaller biasing force is desired to provide a "soft" opening and closing action. In other applications, a larger biasing force is desired to provide an opening and closing action with greater "snap."

A smaller biasing force can result in the lid having a relatively small full opening angle with respect to the base. A larger biasing force can result in the lid having a relatively large full opening angle relative to the base. An improved hinge structure design should preferably accommodate the incorporation of a relatively simple design change so as to provide a closure having the desired opening and closing angle range. A hinge structure with such a capability can provide performance features that are most desirable in a particular application.

Also, it would be desirable if such an improved closure could be provided with a design that would accommodate efficient, high quality, large volume manufacturing techniques with a reduced product reject rate.

Further, such an improved closure should advantageously accommodate its use with a variety of conventional containers having a variety of conventional container finishes, such as conventional threaded or snap-fit attachment configurations.

The present invention provides an improved closure which can accommodate designs having the abovediscussed benefits and features.

SUMMARY OF THE INVENTION

According to the present invention, a closure is provided for an opening to a container interior. The closure includes a base for mounting to the container over the opening. The base defines a discharge aperture communicating with the opening. The closure includes a lid movable between a closed position occluding the aperture and an open position spaced from the aperture. A bistable, snap-action hinge structure connects the lid to the base.

The hinge structure is of the type that includes a web having a central portion between two wider ends wherein an arcuate film hinge connects the base to the web along one side of the web between the ends and wherein an arcuate film hinge connects the lid to the web along another side of the web between the ends. The hinge structure includes at least one abutment surface located so that when the lid is in the closed position, the abutment surface extends adjacent the web central portion from near one of the film hinges toward the other film hinge more than one-half the shortest distance between the film hinges. During the closing and opening of the lid, the abutment surface is contacted by the web central portion whereby the position of the web is controlled.

In a preferred form of the invention, the abutment surface is unitary with the base. The base has a recessed shoulder adjacent the web ends for accommodating seating of the lid thereon when the lid is in the closed position. The abutment surface is oriented perpendicularly relative to the base shoulder adjacent the web central portion. The base has a first, cylindrical arc surface projecting up from the inside of the recessed shoulder, and the base defines an edge at the top of the cylindrical arc surface. The first cylindrical arc surface has a first radius. The film hinge that connects the base and the web is axially spaced from the first cylindrical arc surface top edge.

The abutment surface is defined by a second cylindrical arc surface having a second radius less than the first radius. The second cylindrical arc surface (which defines the abutment surface) projects beyond the first cylindrical arc surface toward the hinge web between the web ends. The location of the abutment surface, the shape of the abutment surface, and the height of the abutment surface along the web of the hinge structure can be varied to increase or decrease the contact between the web and the abutment surface upon closing or opening the lid. This controls the location of the web as the lid is closed or opened. This interaction, as established by the location, shape, and size of the abutment surface, results in a predetermined hinge structure biasing force (e.g., the opening and closing force). This permits the hinge structure to be designed to provide a low biasing force (i.e., a "soft" hinge action) or a greater hinge biasing force to provide a more "snappy" hinge action.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 20 is taken along the plane B—B in FIG. 11, but FIG. 20 shows the lid in an even less open position than does FIG. 19;

DESCRIPTION OF THE PREFERRED EMBODIMENTS

Figure 1:
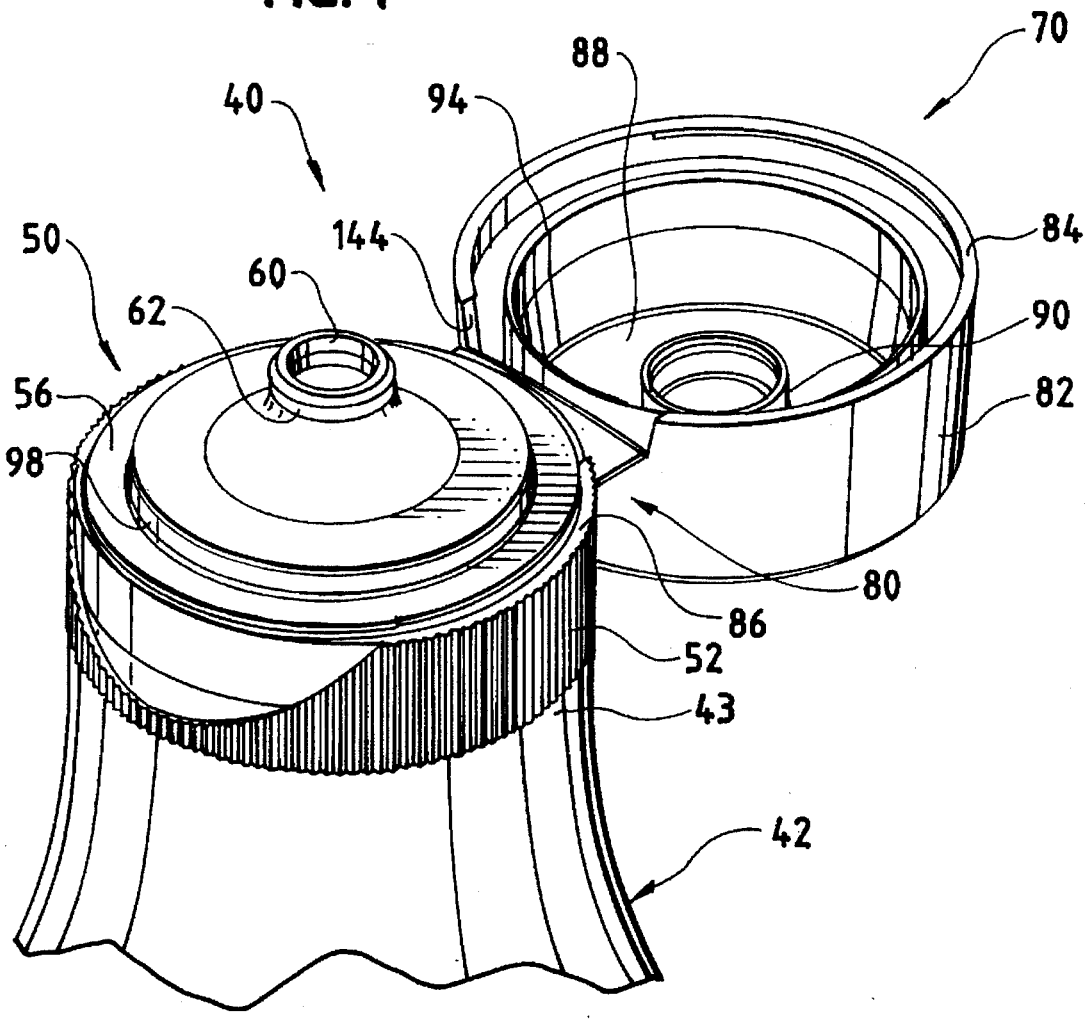
FIG. 1 is a perspective view of a first embodiment of a closure of the present invention shown in the as-molded open position.
Figure 2:
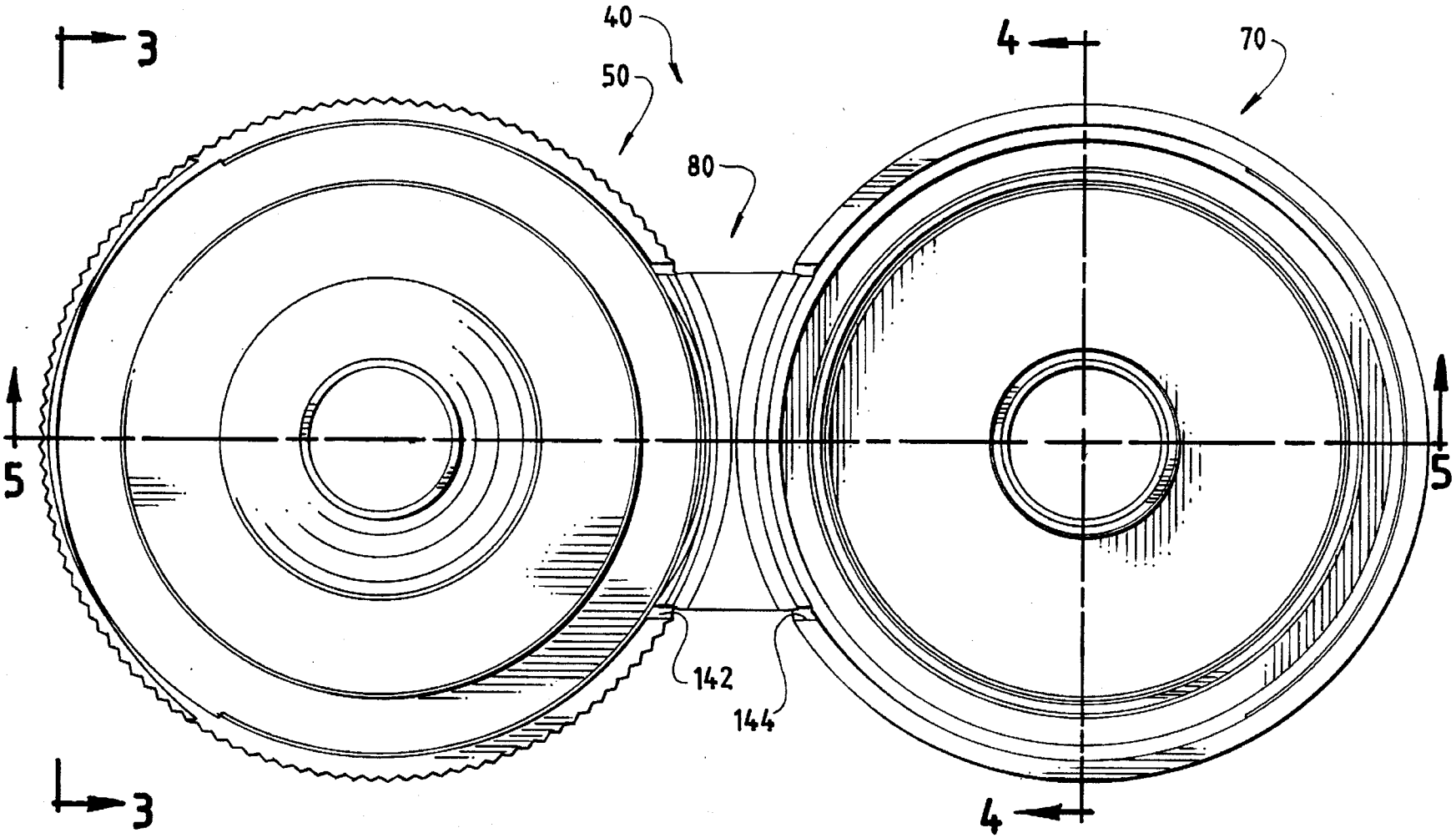
FIG. 2 is a top plan view of the closure in the fully open, as-molded condition.
Figure 3:
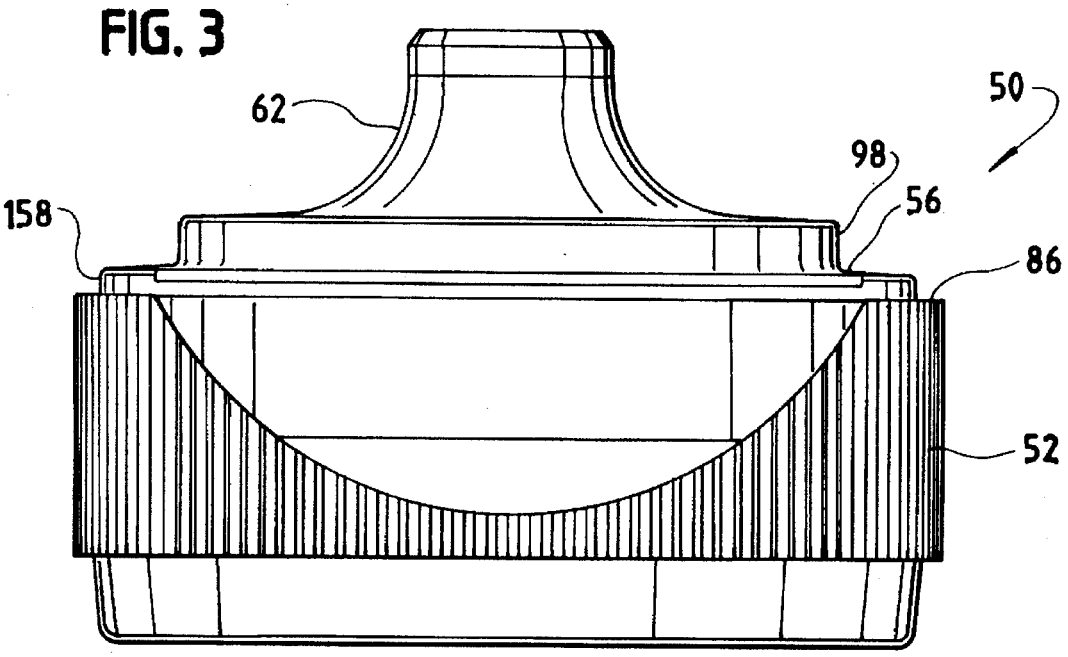
FIG. 3 is a front elevational view of the closure base taken generally along plane 3—3 in FIG. 2.
Figure 4:
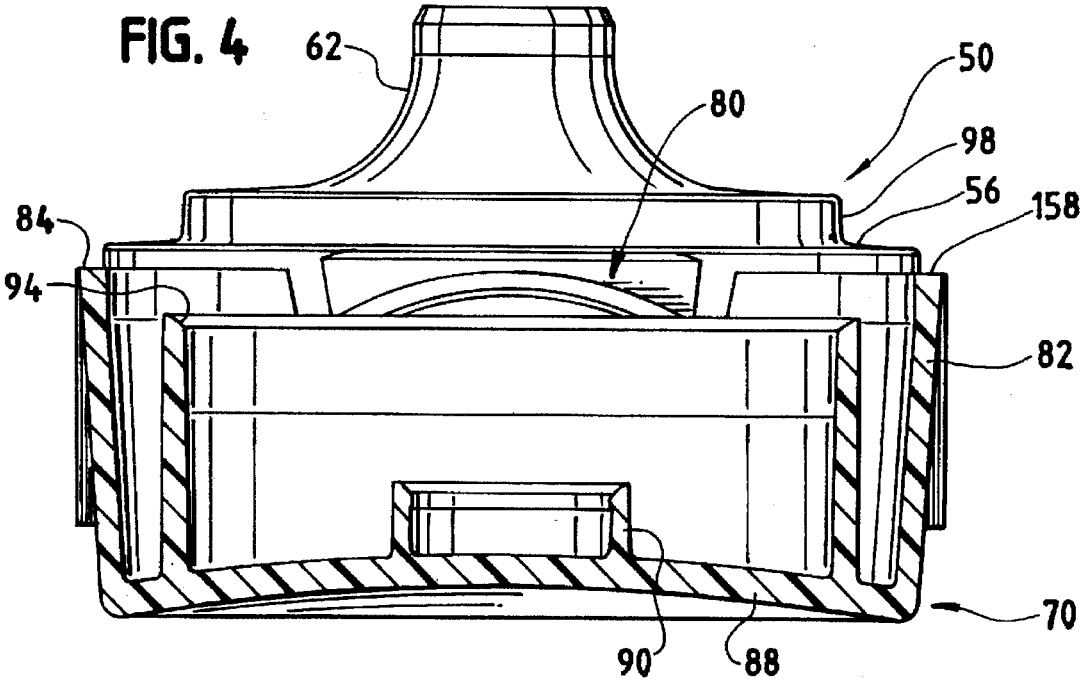
FIG. 4 is a cross-sectional view taken generally along the plane 4—4 in FIG. 2.

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the closure of this invention is described in various positions, and terms such as upper, lower, horizontal, etc., are used with reference to these positions. It will be understood, however, that the closure may be manufactured and stored in orientations other than the ones described.

With reference to the figures, a first embodiment of a closure of the present invention is illustrated in FIGS. 1–21 and is represented generally in many of those figures by reference numeral 40. The closure 40 is adapted to be disposed on a container, such as a container 42 (FIG. 1) which has a conventional mouth or opening (not visible) formed by a neck 43 (FIG. 1) or other suitable structure. The neck 43 typically has a circular cross-sectional configuration, but the body of the container 42 may have another cross-sectional configuration, such as an oval cross-sectional shape, for example. The closure 40 may be fabricated from a thermoplastic material, or other materials, compatible with the container contents.

The container 42 may be stored and used in the orientation shown in FIG. 1 wherein the closure 40 is at the top of the container 42. The container 42 may also be normally stored in an inverted position (not illustrated). When stored in the inverted position, the container 42 employs the closure 40 as a support base.

The container 42 is a squeezable container having a flexible wall or walls which can be grasped by the user and compressed to increase the internal pressure within the container 42 so as to squeeze the product out of the container when the closure 40 is opened (as explained in detail hereinafter). The container wall typically has sufficient, inherent resiliency so that when the squeezing forces are removed, the container wall returns to its normal, unstressed shape.

The closure 40 includes a base or body 50 for being mounted to the container neck 43. The base 50 includes an annular wall 52 (FIG. 5) which has a conventional thread 54 or other suitable means (e.g., a conventional snap-fit bead (not illustrated)) for engaging suitable cooperating means, such as a thread (not visible) on the container neck 43 to secure the closure base 50 to the container 42.

At the top of the closure base annular wall 52, the closure base has a transverse deck 56 (FIG. 5) which extends over the upper, distal end of the container neck 43. The deck 56 has a downwardly extending, annular, internal flexible seal 58 (FIG. 5) which is received against the inner edge of the container neck 43 in the container neck opening so as to provide a leak-tight seal between the closure base deck 56 and the container neck 43.

Figure 5:
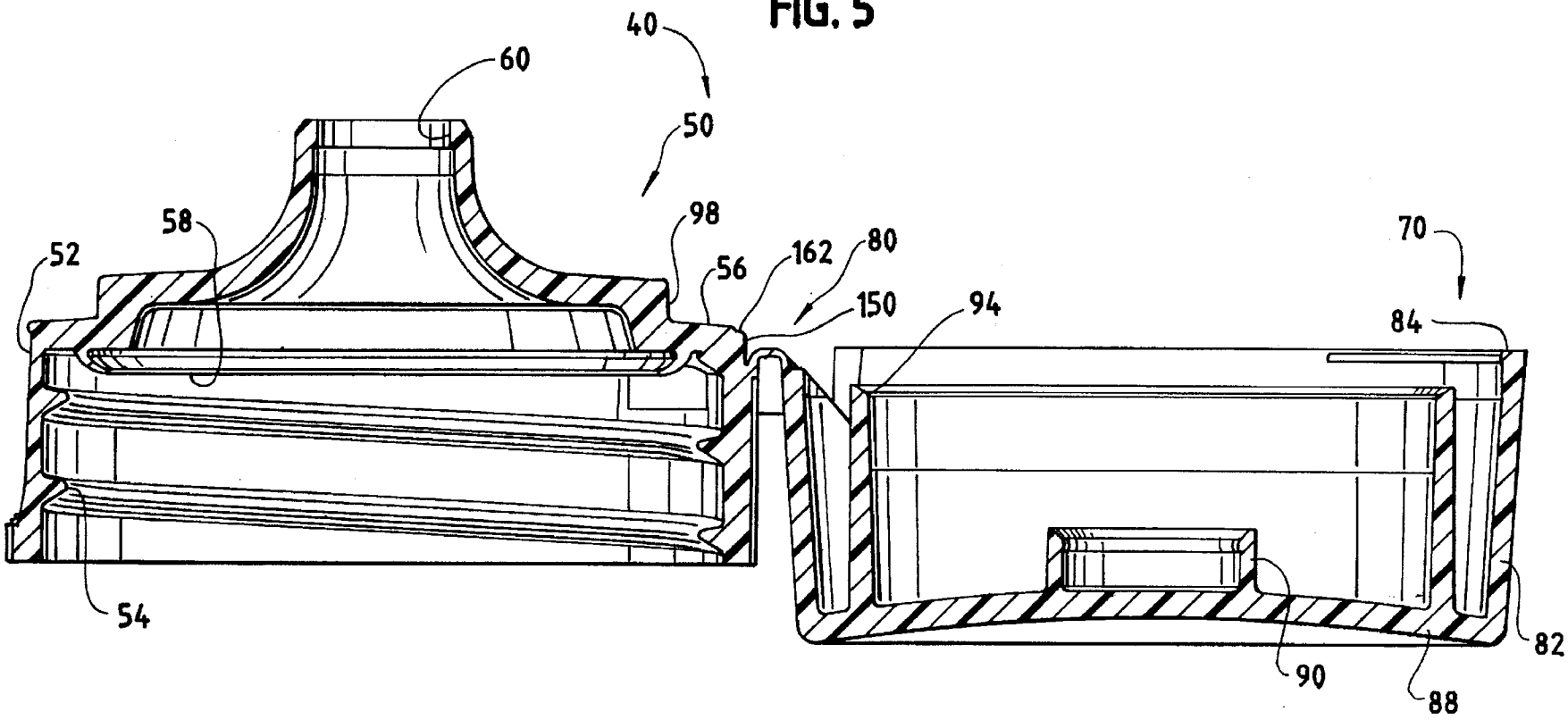
FIG. 5 is a cross-sectional view taken generally along the plane 5—5 in FIG. 2.

As illustrated in FIGS. 1 and 5, the closure base deck 56 has a spout 62 projecting upwardly to define a discharge aperture 60 over the container neck opening.

The closure 40 includes a lid 70 (FIG. 1) connected to the base with a hinge structure 80. The lid 70 includes a peripheral skirt 82 (FIG. 5) defining a peripheral termination surface 84. The lid peripheral surface 84 is adapted to contact or at least confront the closure base 50 when the lid 70 is closed. Preferably, as illustrated in FIG. 1, the closure base 50 defines a peripheral shoulder 86 recessed below the main portion of the deck 56, and the recessed shoulder 86 confronts the surface 84 of the lid skirt 82 when the lid 70 is closed.

The closure lid 70 includes a transverse deck or cover 88 (FIG. 5). Extending from the underside of the lid cover 88 is an annular sleeve 90 which is adapted to be received on, and sealingly engage the exterior of, the closure base spout 62 when the lid 70 is closed.

Figure 6:
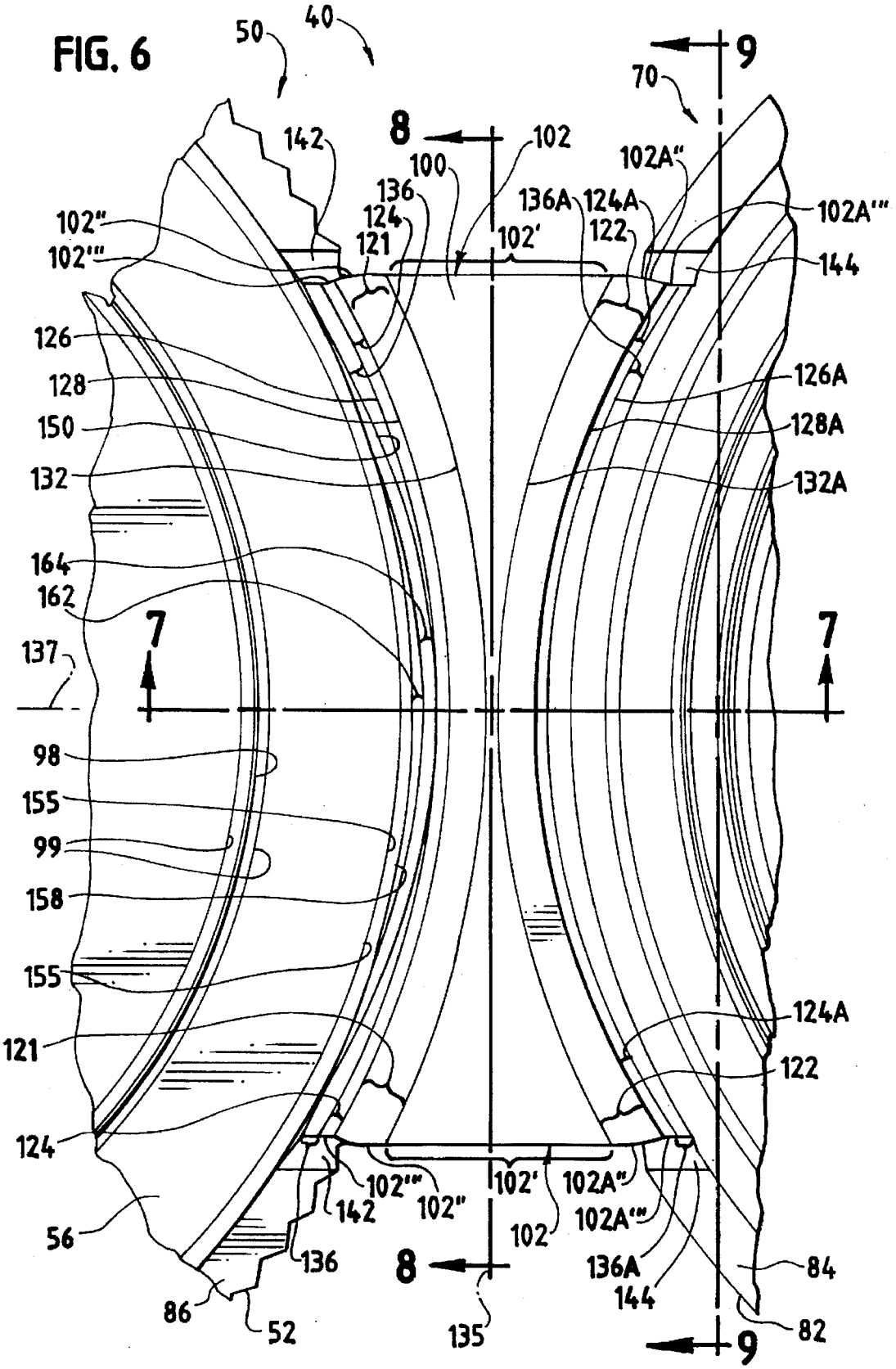
FIG. 6 is a greatly enlarged, fragmentary, top plan view of the hinge structure region of the closure shown in the fully open, as-molded condition in FIG. 2.

The closure lid 70 also preferably includes a an annular sealing collar 94 (FIGS. 1 and 5) which seals against the closure base 50 when the lid 70 is closed. In particular, the closure base 50 defines a vertical wall 98 joining the spout 62 to the deck 56. In FIG. 6, the arcuate lines 99 represent the limits of small radii edge surfaces at the top and bottom of the wall 98. When the lid 70 is closed, the lid annular sealing collar 94 sealingly engages the annular wall 98 on the closure base 50.

In the preferred embodiment, the hinge 80 is integrally molded as a unitary part of the closure with the base 50 and lid 70. One preferred material for molding the closure is polypropylene. It has been found that this material provides a relatively strong, durable closure. The material functions in the hinge structure 80 with desirable biasing forces, has the capability for withstanding typical loads imposed by a user of the closure when the user opens and closes the lid, and has the capability for accommodating a relatively high number of opening and closing cycles without failure.

The hinge structure 80 includes a web 100 having a central portion between two wider ends 102. The two ends 102 are generally parallel in the preferred embodiment illustrated.

Figure 8:
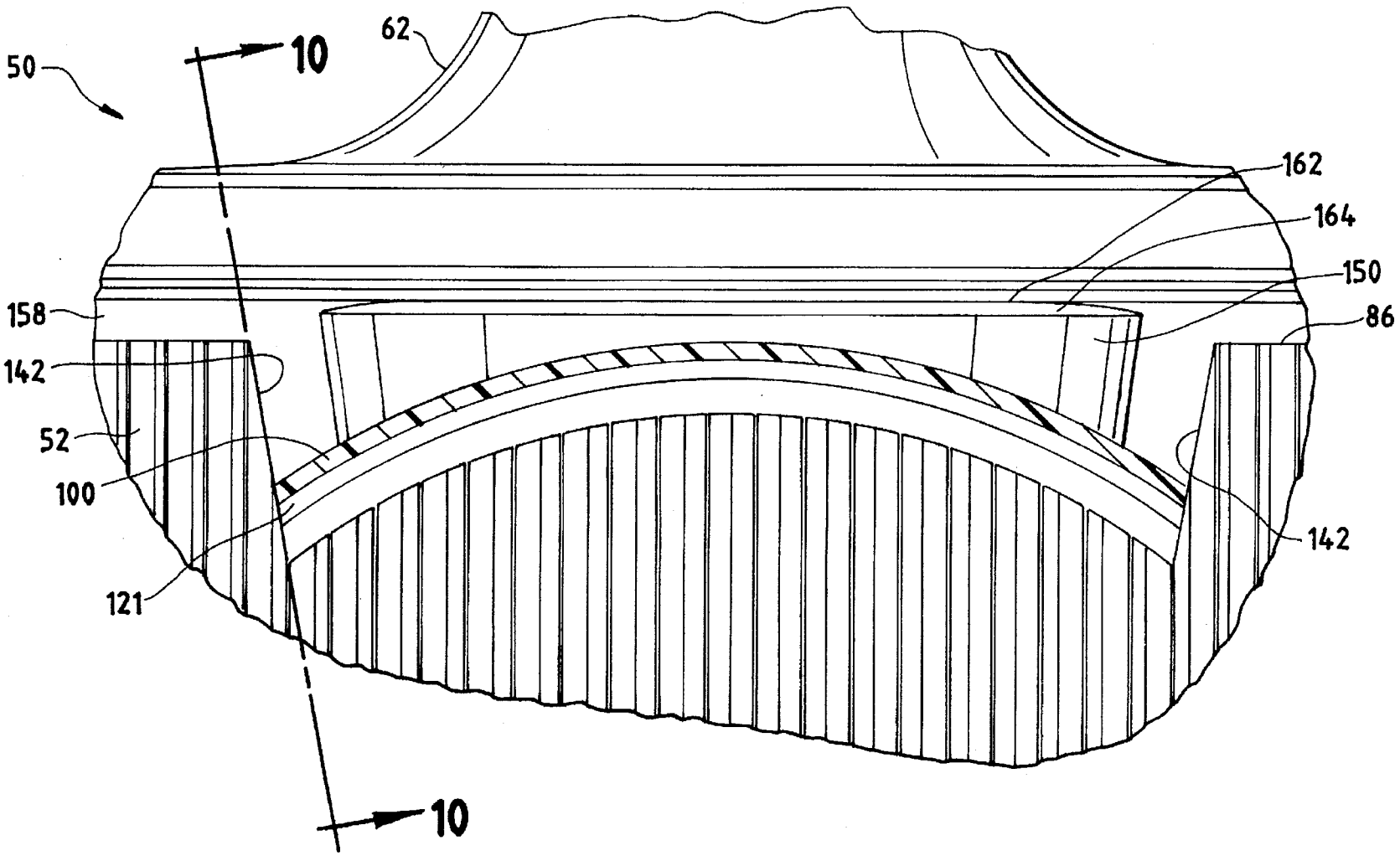
FIG. 8 is a fragmentary, cross-sectional view taken generally along the plane 8—8 in FIG. 6.
Figure 9:
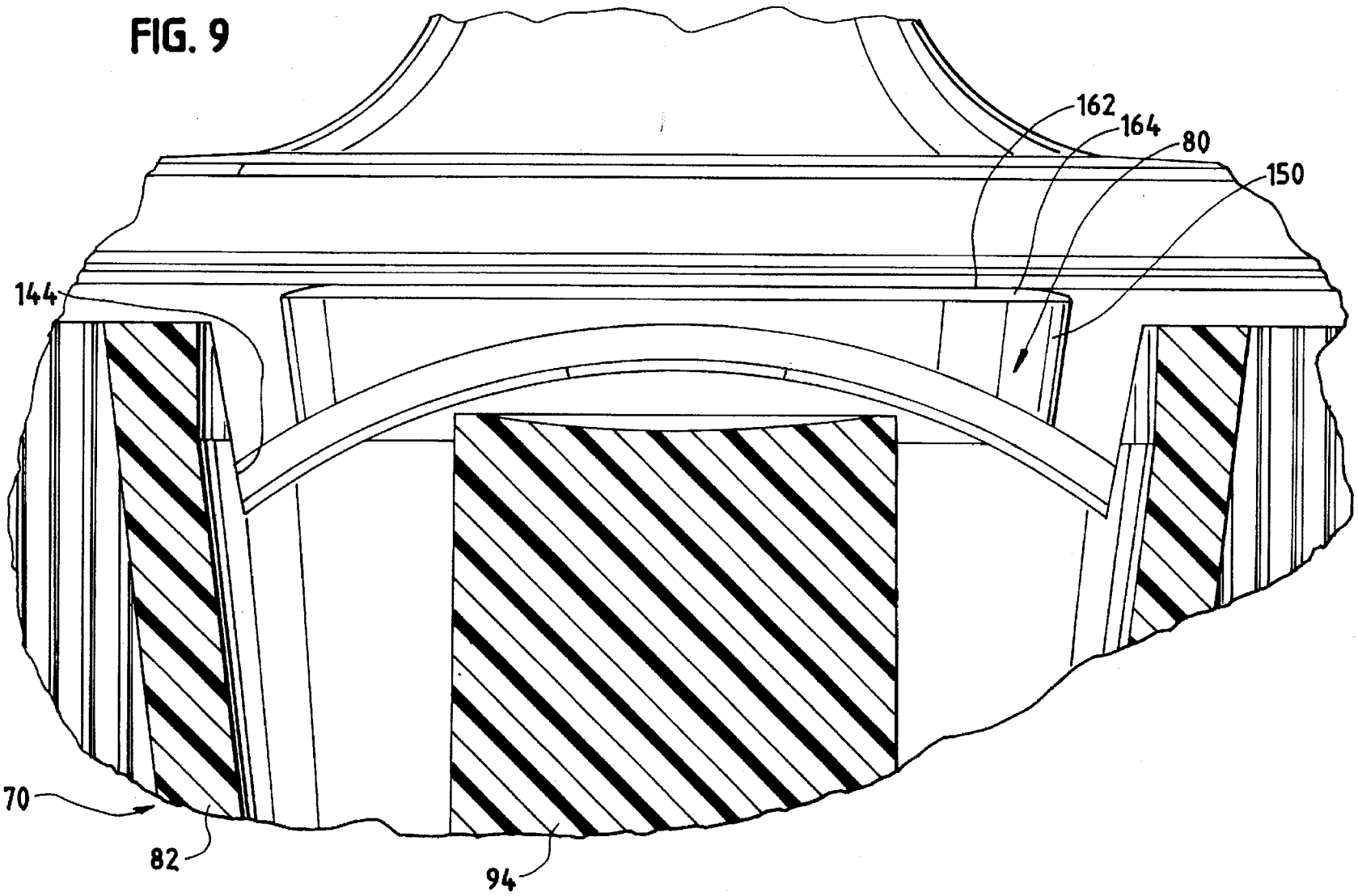
FIG. 9 is a fragmentary, cross-sectional view taken generally along the plane 9—9 in FIG. 6.
Figure 18:
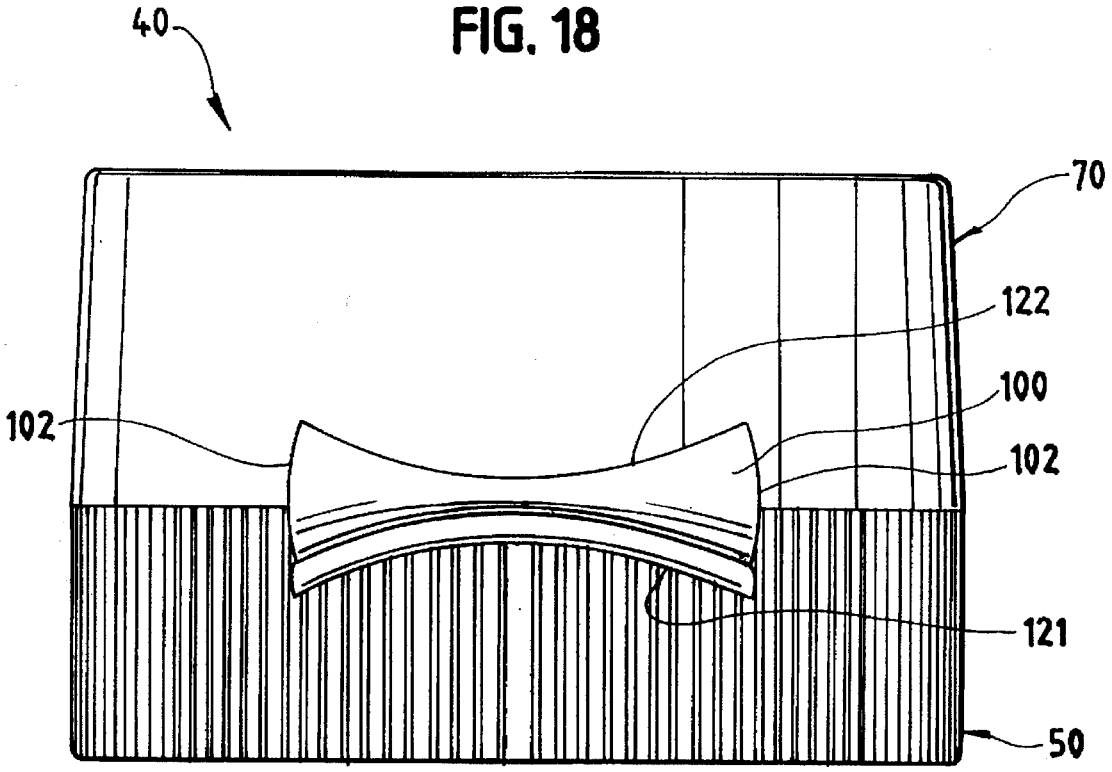
FIG. 18 is a fragmentary, rear elevational view of the closure with the lid in the fully closed position.

A first, arcuate film hinge 121 connects the base 50 to the web 100 along one side of the web 100 between the ends 102. A second, arcuate film hinge 122 connects the lid 70 to the web 100 along another side of web 100 between the ends 102. As illustrated in FIG. 6, the first film hinge 121 lies on an arc concentric with the circumference of the closure base 50, and the second film hinge 122 lies on an arc concentric with the circumference of the lid 70. As illustrated in FIGS. 8 and 18, the first film hinge 121 lies in an upwardly convex curve on the side of the closure base 50. As illustrated in FIGS. 9 and 18, the second film hinge 122 lies on an upwardly convex curve on the side of the closure lid 70.

Figure 7:
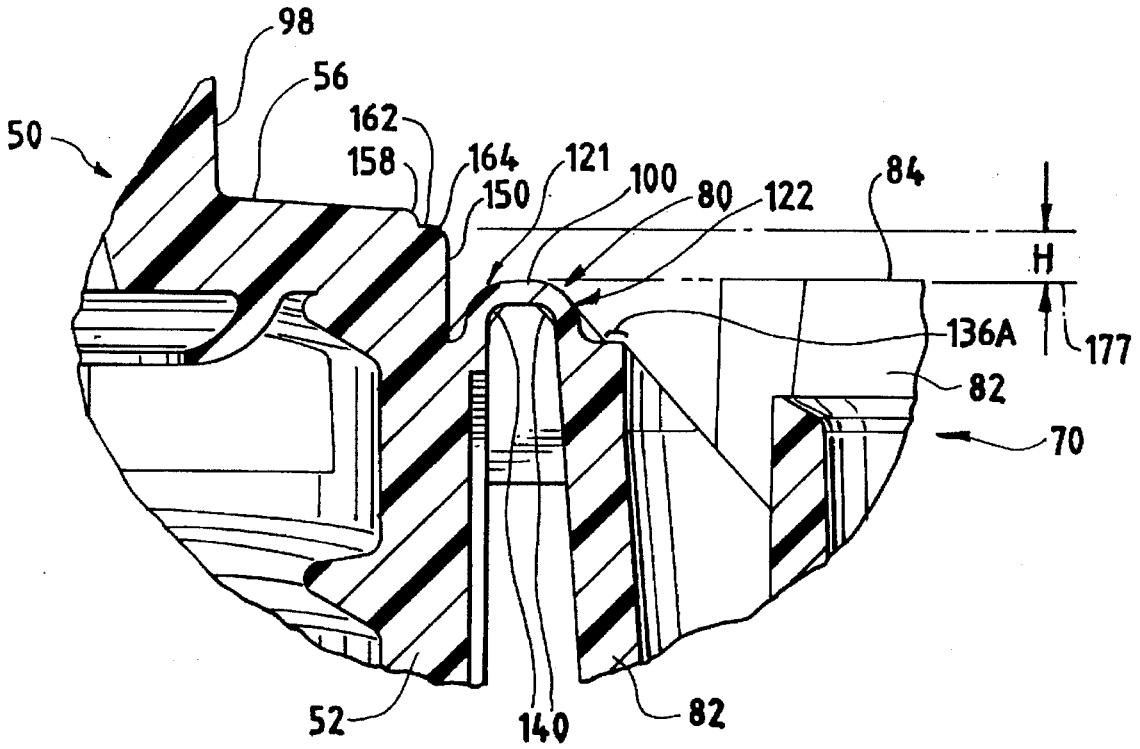
FIG. 7 is a fragmentary, cross-sectional view taken generally along the plane 7—7 in FIG. 6.
Figure 10:
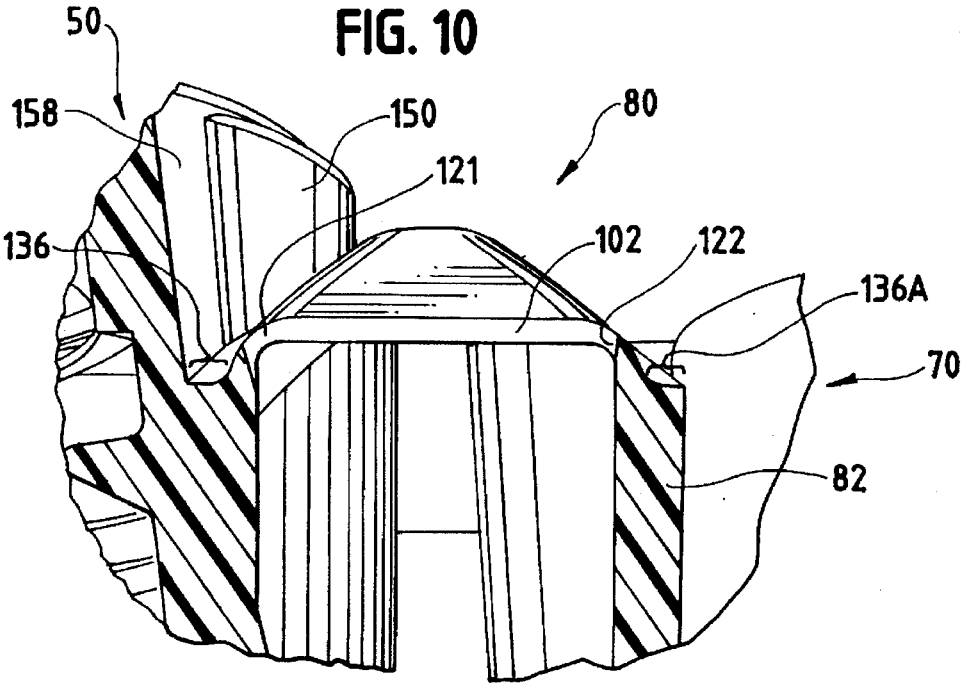
FIG. 10 is a fragmentary, cross-sectional view taken generally along the plane 10—10 in FIG. 8.

In a preferred embodiment as illustrated in FIGS. 6, 7, and 10, the inner surface of the first film hinge 121 has a particular configuration when the lid is fully open. Specifically, the inner surface of the first film hinge 121 (when the lid is fully open) has a curved, radius surface defined between the arcuate line 128 and another arcuate line 132. Adjacent the base side of the film hinge 121 there is a radius surface 124 defined between the arcuate line 128 and an arcuate line 126. The arcuate line 126 defines the locus of tangency between the radius surface 124 and an adjacent shoulder surface 136 on the base 50. The arcuate line 128 defines the locus of tangency between the radius surface 124 and the radius surface of the first film hinge 121. The arcuate line 132 defines the locus of tangency between the radius surface of the first film hinge 121 and the adjacent portion of the web 100.

In a preferred, contemplated commercial embodiment wherein the closure 40 is fabricated from polypropylene, the radius of the surface 124 is 0.01 inch, the radius of the upwardly facing inner surface of the film hinge 121 (as viewed in FIG. 6) is 0.03 inch, and the thickness of the web 100 is 0.012 inch.

The second film hinge 122 has a configuration generally identical to that of the first film hinge 121, except that the second film hinge 122, of course, is oriented in the opposite direction to connect the web 100 to the lid 70. When the lid is fully opened (FIG. 6), the inner surface of the second film hinge 122 has a curved, radius surface defined between an arcuate line 128A and an arcuate line 132A. Along the lid side of the second film hinge 122 there is radius surface 124A. The radius surface 124A is defined the between the arcuate line 128A and an arcuate line 126A.

The arcuate line 126A defines the locus of tangency between the radius surface 124A and an adjacent shoulder 136A on the lid 70. The arcuate line 128A defines the locus of tangency between the radius surface 124A and the adjacent radius surface of the second film hinge 122. The line 132A defines the locus of tangency between the radius surface of the second film hinge 122 and the adjacent portion of the web 100.

The second film hinge 122 preferably has the same configuration and dimensions as the first film hinge 121. Therefore, the radius of surface 124A and the radius of the surface of the film hinge 122 are equal to the radius of surface 124 and the radius of surface of the first film hinge 121, respectively.

With reference to FIG. 7, when the lid 70 is fully open, the radius surface along the outside of each film hinge 121 and 122 along the exterior of the web is designated by the reference numeral 140. In the preferred, contemplated commercial embodiment, the radius of the surface 140 is 0.012 inch.

The hinge structure 80 is accommodated in the closure base 50 by a notch 142 defined in the closure base wall 52

(FIG. 8). Similarly, the hinge structure 80 is accommodated in the closure lid 70 by a notch 144 in the closure lid skirt 82 (FIG. 9).

Preferably, the web 100 is substantially symmetric about a centerline 135 (FIG. 6). Another line 137 is perpendicular to the centerline 135 and passes through the centers of the closure base 50 and closure lid 70. The distance between the centerline 135 and the intersection of the line 137 with the film hinge 121 equals the distance between the centerline 135 and the intersection of the line 137 with the film hinge 122.

The view line 8—8 in FIG. 6 is at the midpoint between the centers of the lid 70 and base 50. If the radius of the closure base connection to the film hinge 121 equaled the radius of the closure lid connection to the film hinge 122, then the film hinges 121 and 122 could also be symmetrically oriented about the closure midpoint (view line 8—8 in FIG. 6). Typically, however, the maximum outside diameter of the shoulder 86 on the closure base wall 52 is about 0.01 inch greater than the maximum outside diameter of the lid skirt 82 at the lid skirt confronting surface 84. As a consequence, the midpoint of the hinge structure 80 along the line 137 is offset slightly toward the lid compared to the point mid-way between the centers of the lid 70 and base 50 (marked by the intersection of view line 8—8 with line 137)

The hinge structure 80 central portion web 100 is narrower than the two ends 102. The widest part of the hinge structure 80 occurs at each end 102. Preferably, the widths of the two ends 102 are equal. A major portion of the width of each end 102 is defined by a straight line segment 102'. The straight line segment 102' is symmetrically disposed relative to the longitudinal centerline 135 of the hinge structure 80. At each end of the segment 102', the end of the first film hinge 121 is defined by an edge 102", and the end of the second film hinge 122 is defined by an edge 102A". The edges 102" and 102A" slant or curve slightly toward the centerline 137 of the closure, which centerline 137 passes through the centers of the closure base 50 and closure lid 70.

Each end of the radius surface 124 is defined by an edge 102'", and each end of the radius surface 124A is defined by an edge 102A'". Each edge 102'" and 102A'" curves or slants from the edge 102" and 102A", respectively, so that the edge joins the shoulder or surface 136 and 136A, respectively, at an orientation that is substantially parallel to the closure centerline 137 joining the centers of the closure base and lid.

In the preferred embodiment illustrated in FIGS. 1–21, the shoulder 136 decreases in width from each end of the hinge structure 80 toward the middle of the hinge structure 80 where the width of the shoulder 136 becomes very small or, preferably, substantially disappears. This occurs because a novel abutment surface 150 (FIG. 6) is provided for controlling the position of the web 100 upon the closing or opening of the lid 70. In the preferred embodiment illustrated, the abutment surface 150 is molded as a unitary part of the closure base 50.

The abutment surface 150 projects outwardly from the closure base 50. The closure base 50 has a generally vertically oriented, cylindrical surface 158 (FIGS. 3 and 7) which extends from the hinge notch 142 above the top of the abutment surface 150. The cylindrical surface 158 extends around the circumference of the closure base deck 56, and the peripheral shoulder 86 projects outwardly therefrom on either side of the hinge notch 142.

The abutment surface 150 projects outwardly from the surface 158 as shown in FIGS. 6,7 and 8. A horizontal ledge 162 is defined at the top of the abutment surface 150 and projects from the cylindrical surface 158. In FIG. 6, arcuate line 155 is the inner end of a radius surface defining the top edge of the cylindrical surface 158. The outer edge of the ledge 162 is defined by a convex radius surface 164 (FIGS. 6 and 8) which merges with the vertical abutment surface 150. In a presently contemplated commercial embodiment, the surface 164 has a radius of about 0.01 inch.

The arcuate film hinge 121 is spaced below the deck 56, below the ledge 162 at the top of the abutment surface, and below the shoulder surface 86 at either side of the hinge notch 142.

In the region of the hinge structure 80, the closure base notch 142 in the closure base annular wall 52 is defined along its bottom by the shoulder 136 (FIGS. 6 and 10) which decreases in width toward the center of the hinge structure 80. Adjacent the central portion of the hinge structure 80, the width of the shoulder surface 136 decreases to nearly zero as the protruding abutment surface 150 projects further outwardly into the surface 136.

The radius of the cylindrical surface 158 (at the outer edge of the deck 56 adjacent the hinge structure 80) is larger than the radius of the exterior, vertical surface of the abutment surface 150. Moreover, both the inner and outer radii of the shoulder 136 are larger than the radius of the exterior, vertical surface of the abutment surface 150.

The abutment surface 150 is defined by a cylindrical arc surface which is preferably positioned symmetrically relative to the web ends 102 so that it projects outwardly from the cylindrical surface 158 into the shoulder 136. In the preferred illustrated embodiment, the abutment surface 150, at the centerline 137 of the hinge structure 80, may be characterized as extending both (1) upwardly to an elevation above the base shoulder surface 86, and (2) downwardly along a vertical line to the shoulder 136 slightly below the first film hinge 121.

The ledge 162 at the top of the abutment surface 150 is recessed below the upper surface of the base deck 56. The elevation of the abutment ledge 162 is established so that when the lid 70 is closed, the lid shoulder surface 136A (FIGS. 7 and 10) will not interfere with the abutment surface ledge 162.

The abutment surface 150 establishes a vertically oriented abutment beyond which the hinge web 100 cannot move when the lid 70 is closed and opened. The abutment surface 150 controls the position of the hinge structure web 100 upon the closing and opening of the lid 70. Preferably, the abutment surface 150 has a vertical height, at the location along the center of the hinge structure 80 (on the centerline 137 of the centers of the closure base 50 and lid 70), which is at or above the second film hinge 122 when the lid 70 is fully closed. In other words, at the longitudinal center of the hinge structure 80 (on centerline 137), the abutment surface 150 extends upwardly above hinge 121 for a distance that is greater than the shortest distance between the film hinges 121 and 122.

Figure 19:
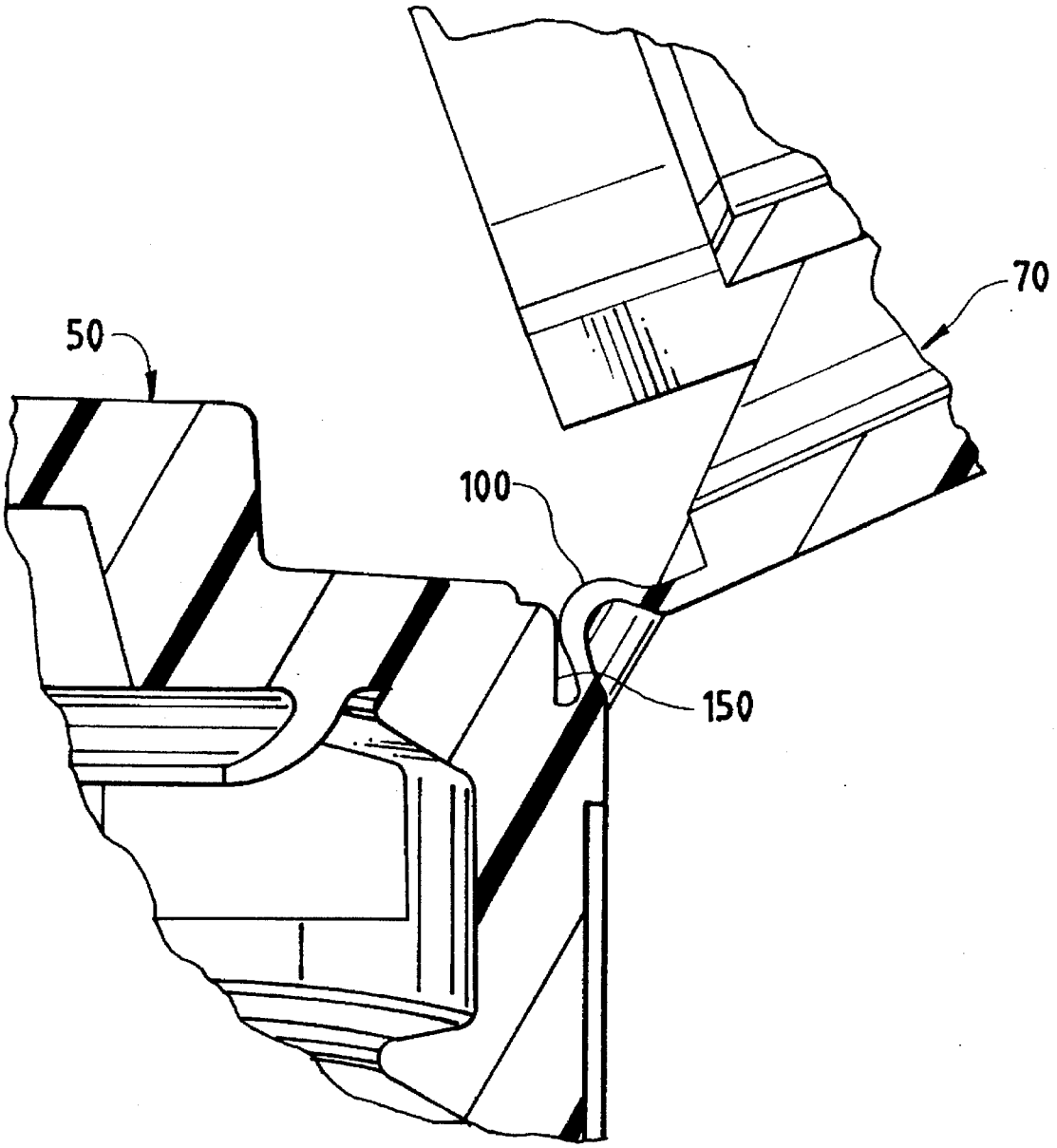
FIG. 19 is an enlarged, fragmentary cross-sectional view similar to FIG. 14 and is taken along the plane B—B in FIG. 11, but FIG. 19 shows the lid in a less open position than do FIGS. 11 and 14.
Figure 20:
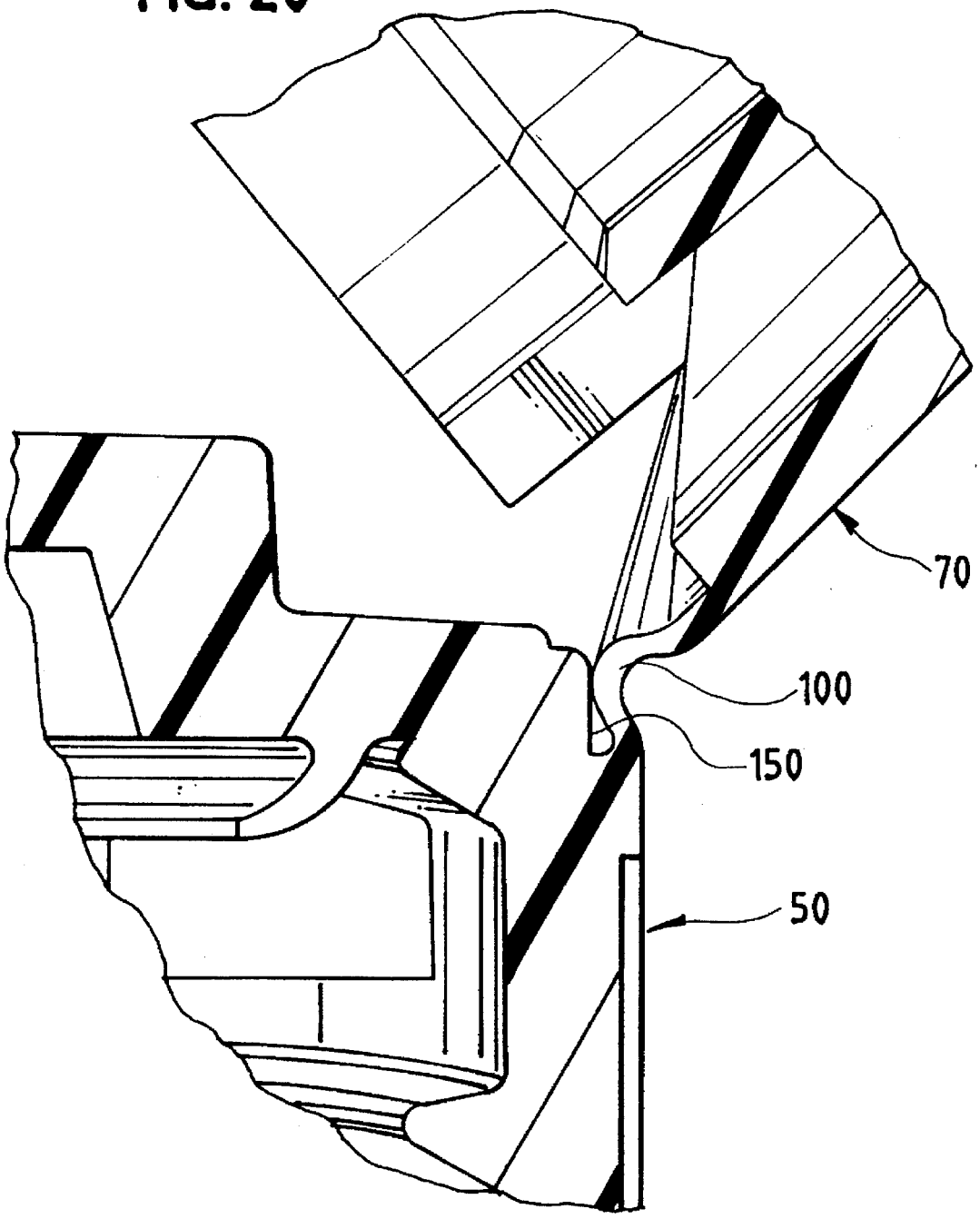
FIG. 20 is an enlarged, fragmentary cross-sectional view similar to FIGS. 14 and 19.

Upon the closing or opening of the lid 70, the hinge structure web 100 engages the abutment surface 150 so that the position of the web 100 is controlled. FIGS. 19 and 20 show how the web 100 bows inwardly toward and against the abutment surface 150 when the lid 70 is partially closed. The abutment surface 150 should preferably extend adjacent the web central portion 100 from the first film hinge 121 toward the second film hinge 122 (when the lid is closed) more than one-half the shortest distance between the film hinges (as measured at the centerline 137 between the web ends 102). However, according to one aspect of the present invention, the abutment surface 150 at the centerline 137 of the hinge structure 80 preferably extends all the way to, and slightly beyond, the film hinge 122 when the lid 70 is closed, and this is presently believed to provide the most accurate control.

The radial extent of the projecting abutment surface 150 can be easily varied during manufacturing according to the hinge characteristics that are desired for a particular application. If the abutment surface 150 projects outwardly a considerable amount, the hinge structure web 100 contacts the abutment surface 150 earlier during the closing process. If the abutment surface projection is less, the hinge structure web 100 would contact the abutment surface 150 later in the closing process, or only when the lid is substantially 100 percent closed.

When the abutment surface 150 projects further outwardly, the biasing action of the hinge structure 80 can be made greater to provide an opening and closing action with more "snap" or force. When the projection of the abutment surface 150 is reduced, the biasing force can be made less, and the opening and closing action of the closure will be "softer." Further, when the abutment surface 150 projects further outwardly, the full open position of the lid defines a greater opening angle relative to the closure base than if the abutment surface 150 projects outwardly a lesser amount.

In a presently contemplated commercial embodiment, the radius of the abutment surface 150 is 0.553 inch and the diameter of the cylindrical surface 158 from which it projects is about 1.320 inch. The height of the abutment surface 150 (at the ledge surface 162), is 0.03 inch from the molding parting plane 177 (FIG. 7) defined by the inner surface of the hinge web 100 when the lid is in the as-molded, fully opened position. In particular, in FIG. 7, the 0.03 inch dimension would correspond to dimension H. In contrast, in the contemplated commercial embodiment, when the lid 70 is in the closed position, the lowest part of the second film hinge 122 (at the centerline 137 between the hinge web ends 102) would be 0.005 inch lower than the abutment surface ledge 162. Thus, the abutment surface 150 extends upward slightly beyond the lowest point of the lid film hinge 122 when the lid 70 is closed.

Generally, in a presently contemplated commercial embodiment, it is desired to provide a hinge structure 80 in which there is substantially no strain in the hinge structure 80 when the lid 70 is in the fully closed position. This minimizes the tendency of the hinge structure 80 to loose its snap-action biasing capability when the lid 70 is maintained closed for long periods of time in the fully closed position.

In alternate designs wherein the hinge structure 80 would have some amount of strain when the lid 70 is in the fully closed position, the strain could, over time, result in some creep of the closure material and subsequent relaxation. This would reduce the amount of biasing force that the hinge structure would exert during opening and closing of the lid.

Figure 11:
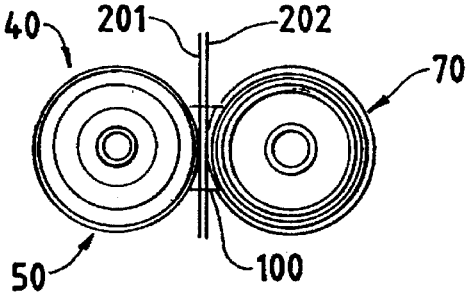
FIG. 11 is a view similar to FIG. 2 but FIG. 11 is shown in a reduced scale.
Figure 17:
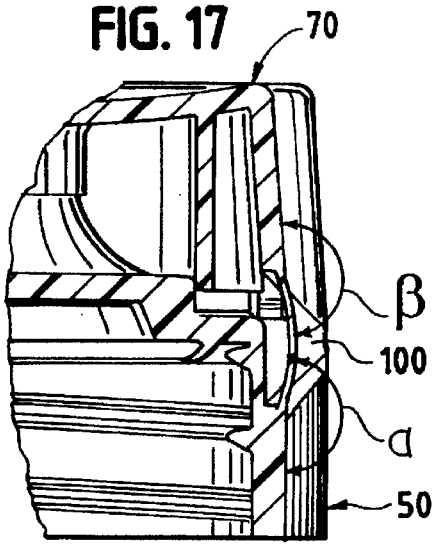
FIG. 17 is a view similar to FIG. 16, but FIG. 17 shows the lid fully closed on the base.

The opening and closing action of the closure incorporating the novel hinge structure of the present invention is illustrated in FIGS. 11–18 and 19–21. FIG. 11 is a top plan view of the closure in the fully open, as-molded condition. FIGS. 12–18 illustrate sequential closing positions with FIGS. 17 and 18 showing the fully closed position.

Figure 12:
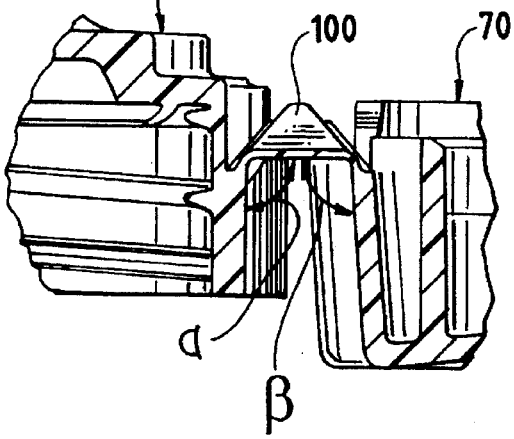
FIG. 12 is a fragmentary, cross-sectional view taken generally along the view plane A—A in FIG. 11.
Figure 13:
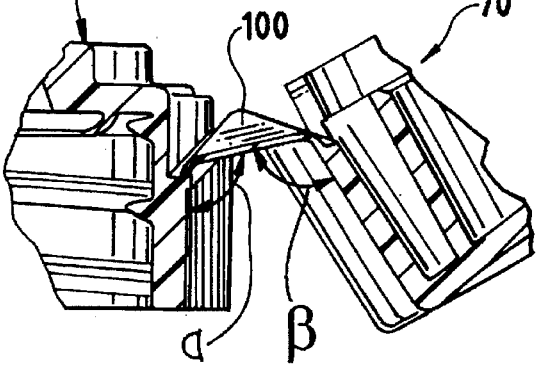
FIG. 13 is a view similar to FIG. 12, but FIG. 13 shows the lid moved 30° from the full open positions of FIGS. 11 and 12 to a partially closed position that is 30° from the full open position.
Figure 14:
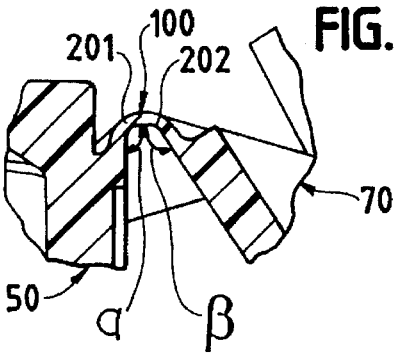
FIG. 14 is a fragmentary, cross-sectional view taken generally along the plane B—B in FIG. 11, but FIG. 14 shows the lid rotated 30° from the full open position to the same orientation as illustrated in FIG. 13.
Figure 15:
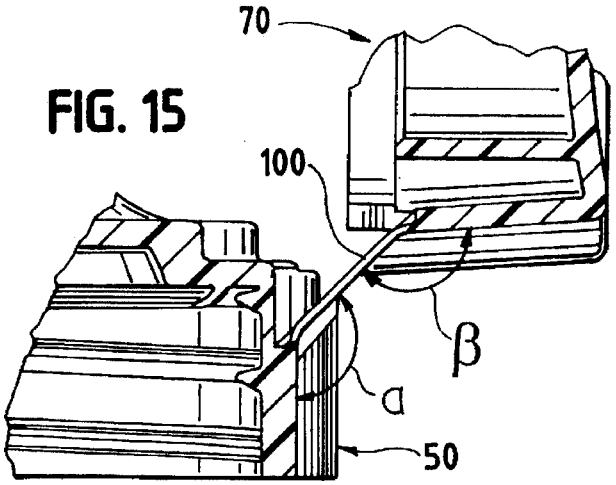
FIG. 15 is a view similar to FIG. 13, but FIG. 15 shows the lid moved to a position 90° from the full open position.
Figure 16:
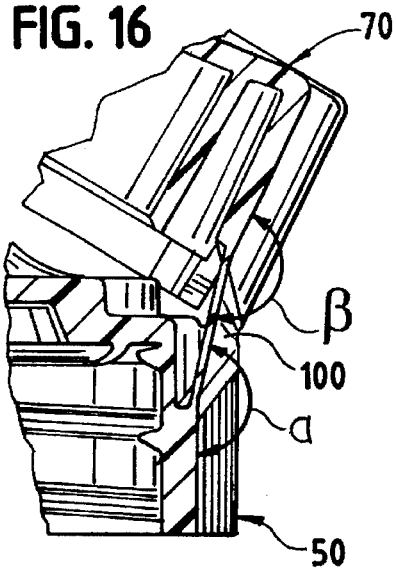
FIG. 16 is a view similar to FIG. 15, but FIG. 16 shows the lid moved 150° away from the full open position.
Figure 21:
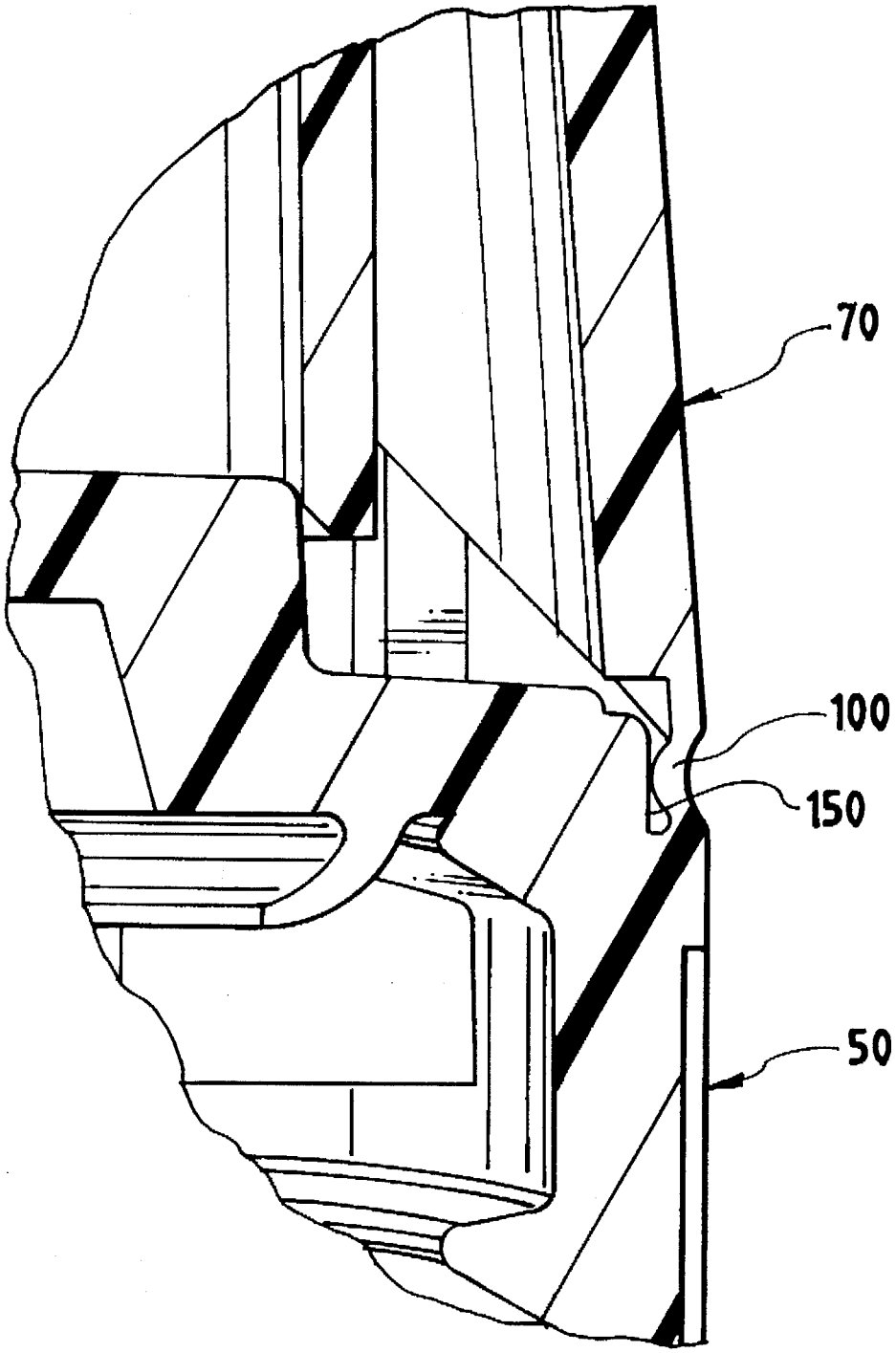
FIG. 21 is an enlarged, fragmentary cross-sectional view similar to FIG. 14 taken along the plane B—B in FIG. 11, but FIG. 21 shows the lid in a fully closed position.

With reference to FIG. 11, the view line A—A represents the section as taken in FIG. 12, and the view line B—B represents the section as taken in FIG. 14. FIGS. 13, 15, 16 and 17 correspond to the same section A—A as FIG. 12, but FIGS. 13, 15, 16 and 17 show the lid in positions moved away from the full open position that is illustrated in FIGS. 11 and 12. FIG. 17 shows the closure fully closed. FIG. 18 is an enlarged, rear elevational view of the closed closure shown in FIG. 17. FIGS. 19 and 20 are enlarged views taken along the plane B—B in FIG. 11, but FIGS. 19 and 20 show intermediate positions of the lid that lie between the two lid positions illustrated in FIGS. 15 and 16. FIG. 21 is an enlarged view taken along the plane B—B in FIG. 11, but FIG. 21 shows the closure closed.

As the closure lid 70 is closed or opened (relative to the base 50 which is assumed to held stationary), the lid 70 moves about two axes 201 and 202 (FIG. 11) which are parallel. The axis 201 is tangent to the film hinge 121, and the axis 202 is tangent to the film hinge 122.

With reference to FIG. 12, it is seen that a transverse cross-section through the web 100 has a substantially linear configuration when the lid 70 is in the as-molded, fully open position. The angle between the web 100 and the closure base 50 is designated by the $\alpha$, and the angle between the web 100 and the closure lid 70 is designated by the angle $\beta$. In the fully open position, which corresponds to the as-molded condition, the angle $\alpha$ and angle $\beta$ are substantially equal.

When the fully open closure 40 is manipulated to a closed condition, the closure base 50 (which is typically attached to the container) is usually held in a generally fixed orientation (by virtue of its mounting to the container) while a closing force is applied to the lid 70. As the lid 70 moves to the closed position, the lid 70 and the web 100 move (counter-clockwise as viewed in FIGS. 12–17)—but not in a fixed relationship relative to the closure base 50.

As seen in FIG. 14, the lid 70 initially pivots about the lid axis 202 through a greater angle $\beta$ compared to the movement of the web 100 about the base axis 201 through a lesser angle $\alpha$. Through much of the closing range (from full open to more than 150° closed as shown in FIGS. 12–16), the pivoting movement of the lid 70 is greater about the web 100 than is the web pivoting movement about the closure base 50. Ultimately, however, at the closed condition (180° as shown in FIG. 17), the lid/web angle $\alpha$ and the web/base angle $\beta$ become equal as shown in FIG. 17. Thus, as the lid 70 reaches the full closed position (FIG. 17), the rate of angular displacement through the angle $\alpha$ at the web/base film hinge 121 becomes greater than the rate of angular displacement through the angle $\beta$ at the web/lid film hinge 122.

It will be appreciated that when the closure base 50 is held stationary while the lid 70 is opened or closed, the web/lid axis 202 moves through space relative to the web/base axis 201. If both the lid 70 and base 50 are permitted to move during closing or opening, then each axis 201 and 202 can move through space.

As the hinge structure 80 is moved from the opened to the closed position, and vice versa, the changes in the distance between the film hinges 121 and 122 near the ends 102 relative to the smaller changes in the distance between the film hinges 121 and 122 at the centerline 137 create a significant tension force or "stretch" at the outer most ends 102. This causes the hinge structure 80 to be unstable in any position between the full open and full closed positions. This results in the hinge structure 80 having an inherent bias (when the lid is between the full open and full closed positions). This urges the hinge structure 80 to assume one of the two bistable positions (either full open or full closed).

The stretch or tension in the hinge structure 80 serves to create a temporary deformation within the hinge structure that is sufficient to move the lid 70 automatically toward the closed position or toward the open position when it is released from any position between the full open and full closed positions. The lid will automatically move to the full closed position if it is released while it is initially closer to the full closed position. On the other hand, the lid will automatically move to the full open position if the lid is released from an initial position which is closer to the full open position.

Figure 22:
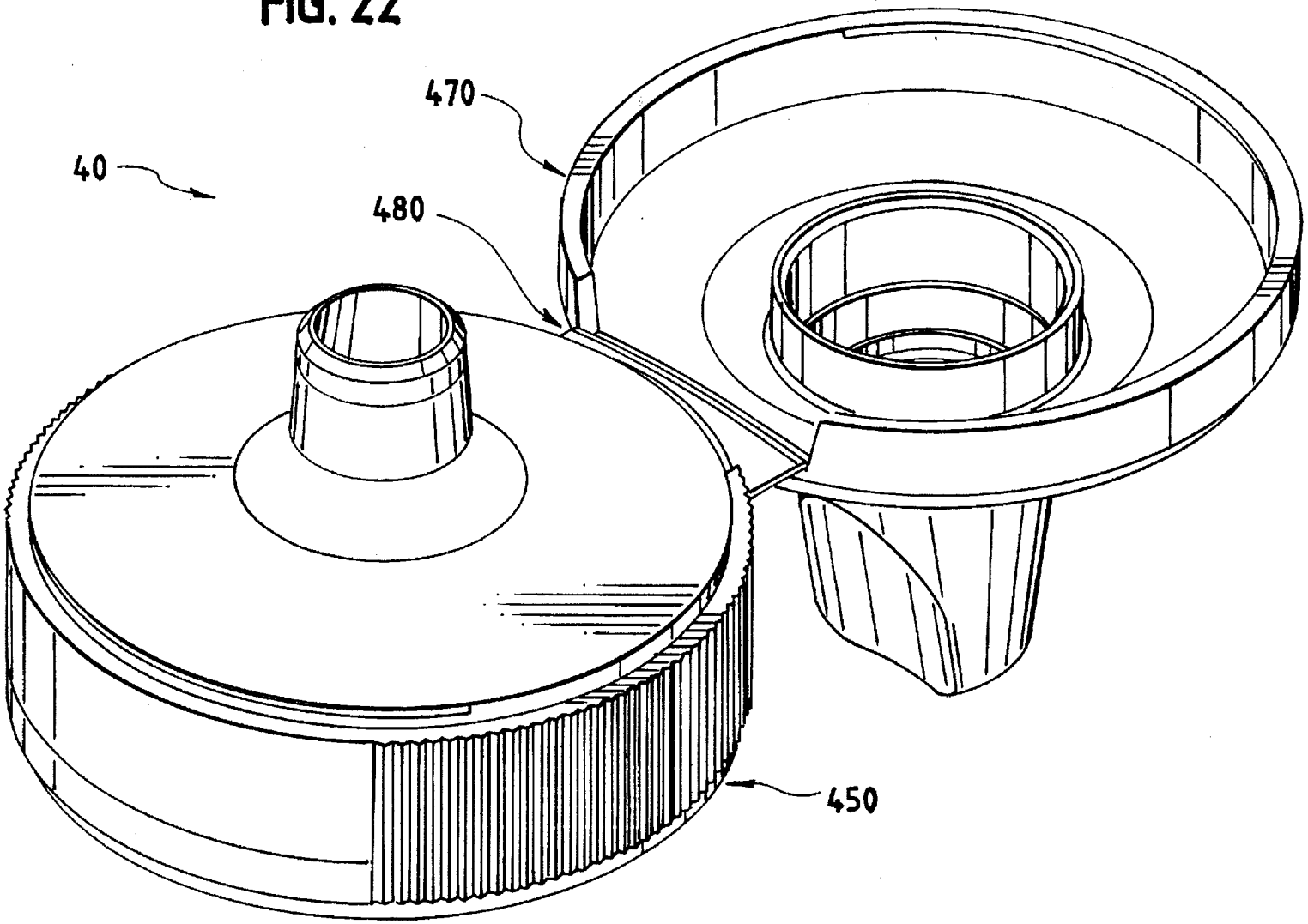
FIG. 22 is a perspective view of a second embodiment of the closure of the present invention shown in the fully open, as-molded position.

The hinge structure 80 of the present invention may be incorporated in a variety of closures. Another type of closure in which the hinge structure may be used is illustrated in FIG. 22 wherein the closure is designated generally by the reference numeral 400. The closure 400 includes a closure base 450 and a closure lid 470. A hinge structure 480 connects the base 450 to the lid 470. The hinge structure 480 is substantially identical to the hinge structure 80 described above for the first embodiment illustrated in FIGS. 1–18.

It will be appreciated that the full open orientation of the closure illustrated in all of the figures (except FIGS. 13–21) corresponds to the initial, as-molded position. This as-molded position preferably has the base and lid opened 180°. Once the lid is first closed and the lid is thereafter opened and maintained free of any exterior forces, the hinge structure will typically maintain the lid in an open position which has an opening angle somewhat less than the substantially 180° opening angle of the original, as-molded, open orientation.

It is seen that the present invention thus provides a closure which has a lid that operates with a snap-action motion while moving to and from a closed position. The hinge structure can be controlled upon closing and opening by the abutment surface. The hinge structure can be substantially strain-free in the fully closed position.

The hinge structure protrudes minimally from the rear of the closure when the closure lid is in the closed position. This is compatible with high speed closure applying machinery employed in conventional container product filling lines. This permits the closure to be used with containers processed at high line speeds.

It will be appreciated that the closure of the present invention provides a system for covering an opening to a container with a closure having a base lid connected by a multiple axis bistable hinge structure. The hinge structure includes a web and an engaging abutment surface which can be designed to provide a small or large biasing force and a small or large lid opening angle.

It will also be appreciated that the closure of the present invention may he provided with a variety of dispensing passage structures.

Further, the closure 40 need not be molded as a unitary article. The hinge structure could be molded as a separate element, and the lid and base could also be molded as separate pieces. The separate hinge structure could then be attacheed (e.g., by welding, adhesive, mechanical snap-fit, etc.) to the lid and base. The abutment surface could be molded as part of the separate hinge structure element or it could be molded as part of the lid or base. However, if the abutment surface is molded as part of the lid or base while the web and film hinges are molded together as an element separate from the lid and base, then the abutment surface may nevertheless still be characterized as being a functional, but separate, part of the novel hinge structure per se. Further, the web could be provided with slots, apertures, or decreased thickness regions.

Also, the abutment surface (e.g., 150 in FIGS. 6 and 8) need not be a single, continuous surface. For example, two slightly separated projecting surfaces could be employed on either side of the closure centerline 137 (FIG. 6).

It will be readily observed from the foregoing detailed description of the invention and from the illustrations thereof that numerous other variations and modifications may be effected without departing from the true spirit and scope of the novel concepts or principles of this invention.

What is claimed is:

1. A closure for a container opening, said closure comprising:

a base for mounting to said container over said opening and defining a discharge aperture communicating with said opening;

a lid movable between a closed position occluding said aperture and an open position spaced from said aperture; and a bistable, snap-action hinge structure that includes a web having a central portion between two wider ends wherein an arcuate film hinge connects said base to said web along one side of said web between said ends and an arcuate film hinge connects said lid to said web along another side of said web between said ends, said web being free of any other film hinge between said two arcuate film hinges, said hinge structure including at least one abutment surface located so that when said lid is in said closed position the abutment surface (1) extends adjacent said web central portion from one of said film hinges toward the other film hinge more than one-half the shortest distance between said film hinges and (2) contacts said web central portion whereby the position of said web is controlled upon the closing and opening of said lid.

2. The closure in accordance with claim 1 in which said abutment surface is unitary with said base.

3. The closure in accordance with claim 1 in which said abutment surface extends from adjacent one of said film hinges for a distance that is greater than the shortest distance between said film hinges.

4. The closure in accordance with claim 1 in which said abutment surface is arcuate.

5. The closure in accordance with claim 1 in which said abutment surface is arcuate.

6. The closure in accordance with claim 1 in which said abutment surface is defined by a partially cylindrical surface and is symmetrically disposed relative to the width of said hinge structure.

7. The closure in accordance with claim 1 in which said hinge structure is unitary with said base and lid.

8. The closure in accordance with claim 1 in which said closure is molded from one of the group of materials consisting of polypropylene and polyethylene.

9. The closure in accordance with claim 1 in which said base and lid each have an exterior wall which defines a notch for accommodating said web.

10. The closure in accordance with claim 1 in which a major portion of the width of each of said web ends is defined by a generally straight line segment; and said segments are generally parallel.

11. The closure in accordance with claim 1 in which the shortest distance between said two film hinges is located along a line midway between said web ends; and said abutment surface is symmetrically located relative to said line.

12. The closure in accordance with claim 1 in which at least one of said film hinges is connected to an adjacent shoulder surface.

13. A closure in accordance with claim 1 in which said web is continuous and free of apertures; and said web has a substantially uniform thickness.

14. A closure for a container opening, said closure comprising:

a base for mounting to said container over said opening and defining a discharge aperture communicating with said opening;

a lid movable between a closed position occluding said aperture and an open position spaced from said aperture;

a bistable, snap-action hinge structure that includes a web having a central portion between two wider ends wherein an arcuate film hinge connects said base to said web along one side of said web between said ends and an arcuate film hinge connects said lid to said web along another side of said web between said ends, said hinge structure including at least one abutment surface located so that when said lid is in said closed position the abutment surface (1) extends adjacent said web central portion from one of said film hinges toward the other film hinge more than one-half the shortest distance between said film hinges and (2) contacts said web central portion whereby the position of said web is controlled upon the closing and opening of said lid;

said abutment surface being unitary with said base;

said base having (1) a cylindrical surface with a first radius, and (2) a recessed shoulder projecting from said cylindrical surface adjacent said web ends for accommodating seating of said lid thereon when said lid is in said closed position;

said abutment surface extending outwardly from said cylindrical surface adjacent said web central portion; and said abutment surface being defined by a cylindrical arc surface having a second radius less than said first radius.

15. A closure for a container opening, said closure comprising:

a base for mounting to said container over said opening and defining a discharge aperture communicating with said opening;

a lid movable between a closed position occluding said aperture and an open position spaced from said aperture;

a bistable, snap-action hinge structure that includes a web having a central portion between two wider ends wherein an arcuate film hinge connects said base to said web along one side of said web between said ends and an arcuate film hinge connects said lid to said web along another side of said web between said ends, said hinge structure including at least one abutment surface located so that when said lid is in said closed position the abutment surface (1) extends adjacent said web central portion from one of said film hinges toward the other film hinge more than one-half the shortest distance between said film hinges and (2) contacts said web central portion whereby the position of said web is controlled upon the closing and opening of said lid;

each said film hinge, when the lid is in the open position, defining a radius surface; and said hinge structure including an adjacent radius surface tangent to each said film hinge radius surface.

16. A unitary closure for a container opening, said closure comprising:

a base for mounting to said container over said opening and defining a discharge aperture communicating with said opening;

a lid movable between a closed position occluding said aperture and an open position spaced from said aperture; and a bistable, snap-action hinge structure that is unitary with said base and lid and that includes a web having a central portion between two wider ends wherein an arcuate film hinge connects said base to said web along one side of said web between said ends and an arcuate film hinge connects said lid to said web along another side of said web between said ends, said web being free of any other film hinge between said two arcuate film hinges, said hinge structure including at least one abutment surface located so that when said lid is in said closed position the abutment surface extends adjacent said web central portion between said film hinges for a distance at least equal to the shortest distance between said film hinges, said web central portion contacting said abutment surface when said lid is in said closed position whereby the position of said web is controlled upon the closing and opening of said lid.

17. The closure in accordance with claim 16 in which said base has (1) a cylindrical surface with a first radius, and (2) a recessed shoulder projecting from said cylindrical surface adjacent said web ends for accommodating seating of said lid thereon when said lid is in said closed position; and said abutment surface is defined by a cylindrical arc surface having a second radius less than said first radius.

18. A closure in accordance with claim 16 in which said web is continuous and free of apertures; and said web has a substantially uniform thickness.

* * * * *

UNITED STATES PATENT AND TRADEMARK OFFICE

CERTIFICATE OF CORRECTION

PATENT NO. : 5,642,824

DATED : July 1, 1997

INVENTOR(S) : John M. Hess III, Nicholas J. Jelich, and Bruce M. Mueller

It is certified that error appears in the above-indentified patent and that said Letters Patent is hereby corrected as shown below:

In FIG. 11, on the drawing sheet 9/15, add the view lines --A-A-- and --B-B-- as shown on the attached portion of the revised drawing sheet 9/15

Signed and Sealed this

Third Day of February, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO 5,642,824

DATED July 1, 1997

INVENTOR(S) John M. Hess III, Nicholas J Jelich, and Bruce M. Mueller

It is certified that error appears in the above-indentified patent and that said Letters Patent is hereby corrected as shown below

9/15

FIG 10

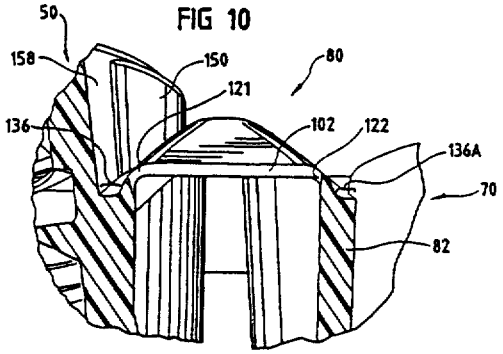

FIG. 11

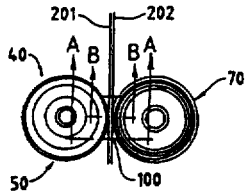

FIG 12

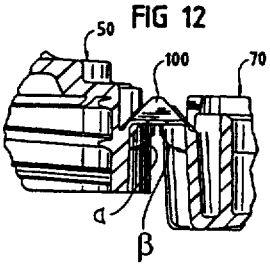

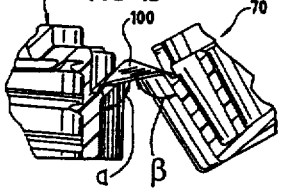

FIG 13